United States Patent [19]

Irwin

[11] 4,153,966

[45] May 15, 1979

[54] SPRING FEED DEVICE

[76] Inventor: Lawrence F. Irwin, 12860 San Fernando Rd., Sylmar, Calif. 91342

[21] Appl. No.: 914,630

[22] Filed: Jun. 12, 1978

[51] Int. Cl.[2] ..... B08B 9/02

[52] U.S. Cl. ..... 15/104.3 SN

[58] Field of Search ..... 15/104.3 R, 104.3 SN; 226/52

[56] References Cited

U.S. PATENT DOCUMENTS

| | | | |
|---|---|---|---|
| 3,329,044 | 7/1967 | Singer | 15/104.3 SN X |
| 3,882,565 | 5/1975 | Irwin et al. | 15/104.3 SN |

*Primary Examiner*—Edward L. Roberts

*Attorney, Agent, or Firm*—James E. Brunton

[57] ABSTRACT

A feed control device for use in conjunction with both hand held and wheel mounted plumbing tools of the type used for cleaning and removing obstructions from drain pipes in which an elongated coiled spring wire, or plumber's snake, is advanced through the pipe and rotated. The feed control device includes a novel snake feeding mechanism movable into and out of engagement with the snake and includes a biasing means for yieldably urging helically grooved feed rollers, which form a part of the feeding mechanism, into driving engagement with the snake. With this arrangement the device can readily accomodate distortions and irregularities in the snake without damaging either the snake or the plumber's tool. The helically grooved rollers which drivably engage the snake are uniquely constructed with double or triple lead threads, or grooves, which cause the snake to be fed at a significantly increased rate of speed than is possible with conventional feeding devices. Adjustment means are provided to regulate the force exerted by the biasing means on the feed rollers to enable ready adjustment of the feeding mechanism and to accomodate for wear.

15 Claims, 6 Drawing Figures

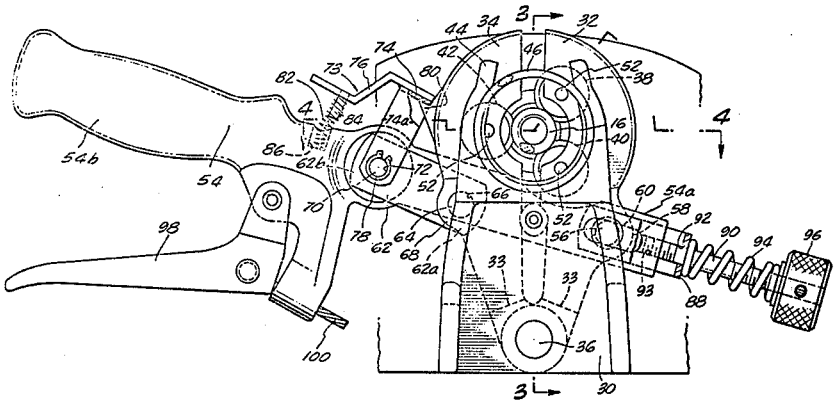

SPRING FEED DEVICE

BACKGROUND OF THE INVENTION

1. Field of the Invention

The present invention relates generally to plumber's tools adapted for cleaning and removing obstructions from drain pipes and using an elongated member in the form of a coiled spring wire, known as a plumber's snake, which is advanced through the pipe and rotated. More particularly the invention relates to an improved snake feed device for use in connection with a plumber's tool embodying power means for rotating the snake.

2. Discussion of the Prior Art

Spring-type plumber's snakes are ordinarily housed in a drum or container having a conoidal wall through which the spring or snake is fed and retracted axially of itself as the container is rotated to cause rotation of the spring. In conventional tools having power-operated spring advancing and retracting means, the feed mechanism typically includes a jaw in the form of a segmented nut, or the like, through which the spring is fed by rotating it so that, in effect, the spring is threaded through the jaw. Since the jaw is stationary, the rate of feed of the spring or snake is entirely dependent upon its speed of rotation. Further, the stationary jaw cannot accomodate irregularities in the spring such as kinks, couplings and the like and if such irregularities are encountered, serious damage to the equipment can result. Also, should the spring or snake encounter a restriction within the pipe which it cannot immediately penetrate, the driving torque will build up against the stationary jaw causing the snake to kink and frequently break, thereby creating a significant safety hazard.

Various attempts have been made in the past to design a snake feed device which would permit the operator to quickly stop the feed should a blockage be encountered within the pipe. Among the most successful of these prior art devices are the devices invented by Hunt, et al., and described in U.S. Pat. Nos. 2,769,191, 3,224,024 and 3,499,782. These devices, while clearly superior to similar units on the market, nevertheless have the drawback that the feed jaws cannot accommodate any appreciable distortion in the spring and the feed of the spring is controlled entirely by the operator. Unless the operator is continuously alert to any indication of impedance to forward feed of the spring within the pipe, and quickly responds by stopping the feed, the buildup of driving torque can cause serious damage to the equipment and possibly injure the operator as well.

A highly successful device adapted to uniformly feed the coiled spring and to accomodate for distortion and irregularity therein is described in my earlier U.S. Pat. No. 3,882,565. The present invention comprises a simplified and improved version of the feed device described therein.

Certain types of prior art devices have attempted to feed the snake by using cooperating rollers set at an angle relative to the longitudinal axis of the snake. For example, by placing three roller wheels at a synchronized angle, a rotating spring can be urged forwardly. Such a system or arrangement, however, necessitates the exertion of significant downward pressure on the spring by the wheels. The exertion of too much pressure can "bind" the spring and too little pressure can cause undue slippage. In the present invention, helically grooved rollers are used and a minimum amount of pressure on the coiled spring by the rollers causes uniform feeding of the spring without binding or slippage.

SUMMARY OF THE INVENTION

It is an object of the present invention to provide a plumbing tool of the type employing an elongated coiled spring wire, or snake, which is rotated and fed into drain pipes and the like, in which there is provided a novel spring loaded snake feed mechanism adapted, during the feed mode, to automatically accommodate distortions and irregularities in the coiled spring without damaging either the coiled spring or the plumber's tool.

It is another object of the invention to provide a feed device as described in the preceeding paragraph which automatically feeds the snake at a significantly faster rate of speed than is achieved with conventional jaws for any given rotation speed of the snake. In this regard it is an object to provide a novel form of snake engaging means embodying a plurality of rotatable helically grooved feed rollers engagable by the snake and rotated thereby in a direction opposite to the direction of rotation of the snake whereby the snake is fed at a faster rate of speed than is possible with conventional jaws.

It is still another object of the invention to provide a device of the aforementioned character in which the feed mechanism includes feed rollers movable into and out of driving engagement with the snake and further includes a biasing mechanism for yieldably urging the feed rollers into driving engagement with the snake which is so constructed and arranged as to exert minimum pressure on the coiled spring and to permit the elements to accommodate distortions and irregularities in the snake and to move out of driving engagement with the snake in response to forces opposing feeding of the snake axially of itself.

It is a further object of the invention to provide a device as described in the preceeding paragraph in which the biasing mechanism is adjustable so that the force exerted thereby to hold the feed rollers in driving engagement with the snake may be controllably varied.

It is yet another object of the invention to provide a device of the class described in which the feed rollers are carried by jaws which are in turn interconnected with an elongated transversely extending manually operable handle adapted to move the jaws and the feed rollers toward and away from the snake.

It is another object of the invention to provide a device as described in the preceeding paragraph which includes a manually operable safety latching device adapted to releasably lock the jaws in a closed position with the feed rollers in driving engagement with the snake.

It is still a further object of the invention to produce a novel, low-cost, lightweight feed means which is relatively simple in design and can be readily attached to both hand held and wheel mounted tools presently on the market, and which can easily be operated. In this connection it is an object to provide such a means which can be readily engaged or disengaged by the operator with very little effort and without any particular skill.

These and other objects will be apparent from the drawings and the following description.

DESCRIPTION OF THE INVENTION

Figures 1, 2:
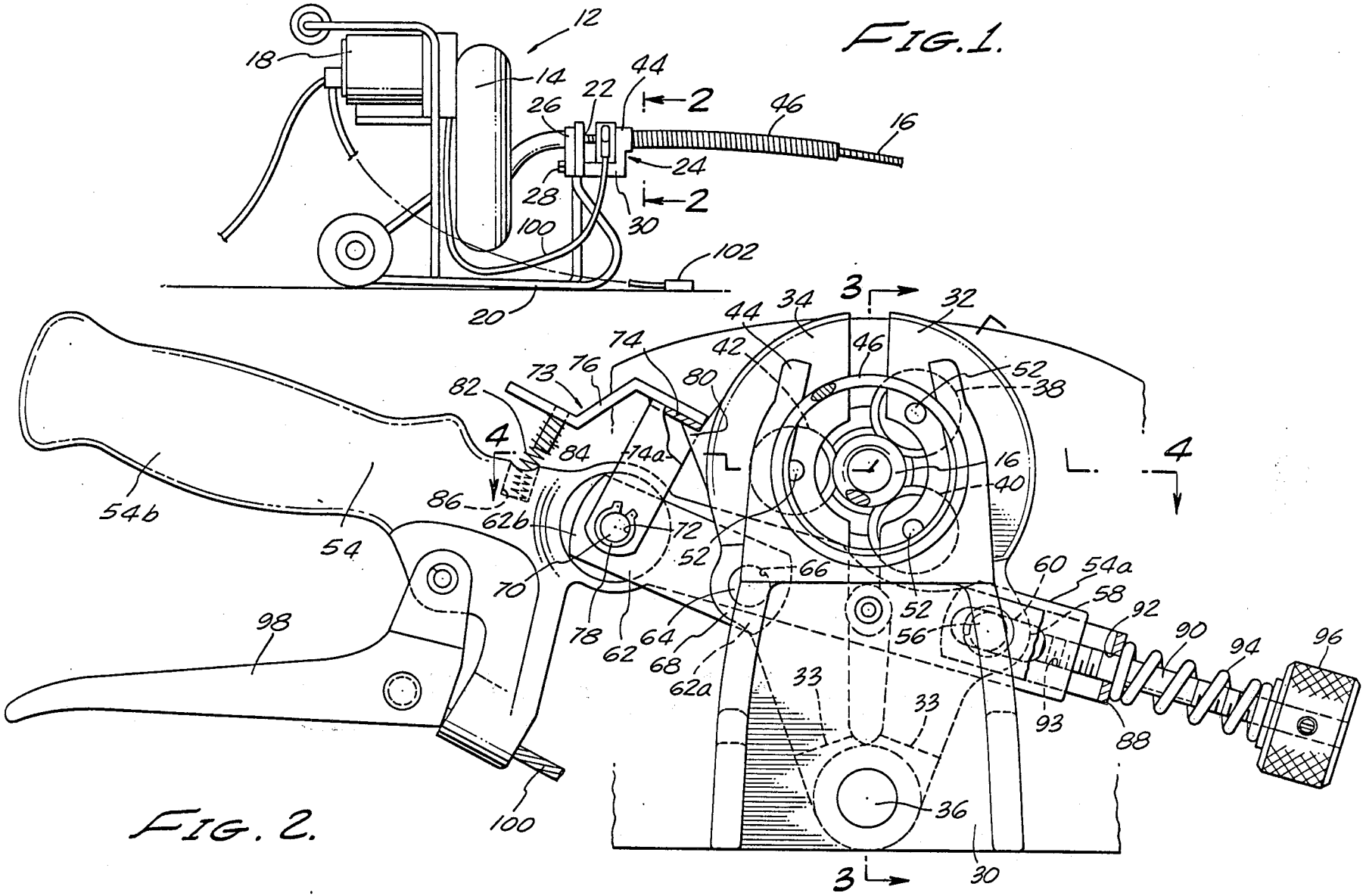
FIG. 1 is a side elevational view of a wheel mounted tool with the device of the invention mounted thereon.
FIG. 2 is a central longitudinal view through the forward portion of the device of the invention taken along lines 2—2 of FIG. 1 but on a larger scale.

Referring to the drawings, FIG. 1 shows one form of the plumbing tool of the invention generally designated by the numeral 12. The tool includes a snake housing 14 in which may be coiled a plumber's snake 16, shown as a tightly coiled spring wire or cable. The housing 14 has mounted thereon a reversible electric motor 18 which is used for rotating the housing and the coiled spring or snake encased therein, either in a clockwise or counterclockwise direction. In this embodiment of the invention, the housing and the motor are mounted on a wheeled cart 20 for ease of transport and are interconnected in a conventional manner to permit controlled rotation of the housing. Snake housing 14 is provided with an opening 22 which is concentric with the axis of rotation of the housing and through which the rotating coiled spring 16 may be fed.

Figure 3:
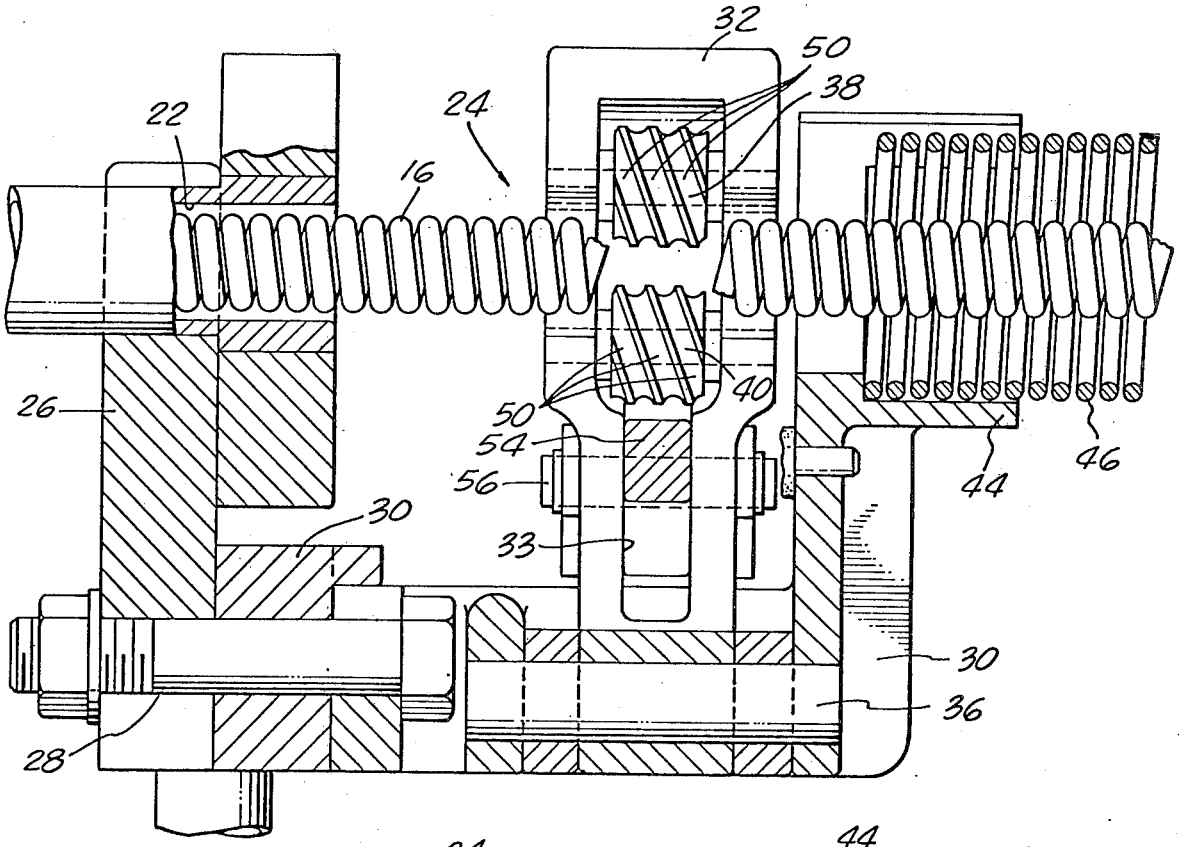
FIG. 3 is a sectional view on line 3—3 on FIG. 2.

The feed control device of this form of the invention, generally indicated by the numeral 24, is located forwardly of the snake housing and, as also shown in FIG. 3 is affixed to a bracket 26 on cart 20 by means of a threaded stud 28.

Figure 4:
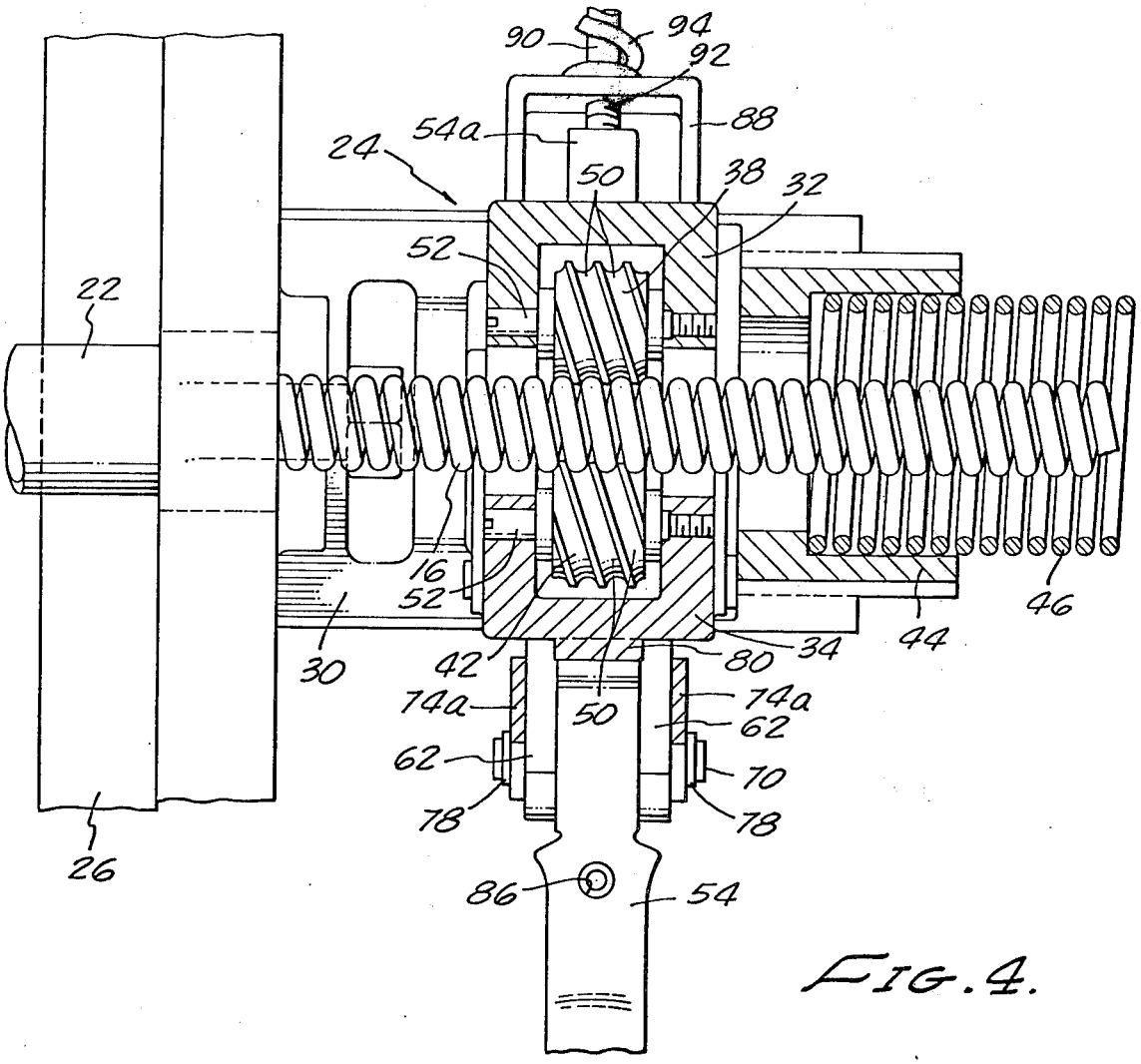
FIG. 4 is a sectional view taken along lines 4—4 of FIG. 2.

Turning now particularly to FIG. 2, 3 and 4, the feed device of the invention can be seen to comprise a body 30 adapted to be attached to bracket 26 and snake engaging means including first and second opposing jaws 32 and 34 respectively (FIG. 2) which are pivotally connected to body 30 by means of a pivot pin 36. Jaws 32 and 34 are adapted for relative pivotal movement with respect to each other about the longitudinal axis of pivot pin 36 from a first position as shown in FIG. 5 wherein the jaws are spaced apart to a second position as shown in FIG. 2 wherein the jaws are in close proximity.

Rotatably carried by first jaw 32, are a pair of vertically spaced apart, helically grooved feed rollers 38 and 40. Rotatably carried by second jaw 34 is a similarly constructed, helically grooved roller 42. With jaws 32 and 34 closed as shown in FIG. 2, the feed rollers 38, 40 and 42 are in drivable engagement with the snake 16 as it passes axially therebetween and extends forwardly of the apparatus.

Forming a part of the upper forward portion of body 30 is a generally cylindrically shaped sleeve portion 44 adapted to closely receive an elongaged tubular snake shielding member 46 which functions as a personnel shield. As best seen by referring to FIG. 3, feed rollers 38, 40 and 42 are of unique design with each being formed to provide peripheral helical channels, or grooves 50 which have the same pitch as the coils of the snake and which are adapted to engage the snake, or coiled spring 16, when the jaws 32 and 34 are in their closed position. Each feed roller is freely rotatable in either direction about the axis of axles 52 carried by jaws 32 and 34. In order to effect a significantly increased rate of feed or retraction of the snake, the lead of the helical grooves of the feed rollers is increased as indicated in FIG. 4 to provide, in effect, a triple thread or coil advance. With the construction shown in FIGS. 2 and 3, as the snake 16 is rotated by rotation of drum 14, rollers 38, 40 and 42 will rotate in the opposite direction urging the snake either to rapidly feed out, or to rapidly retract, depending upon the direction of rotation of the drum.

Figure 5:
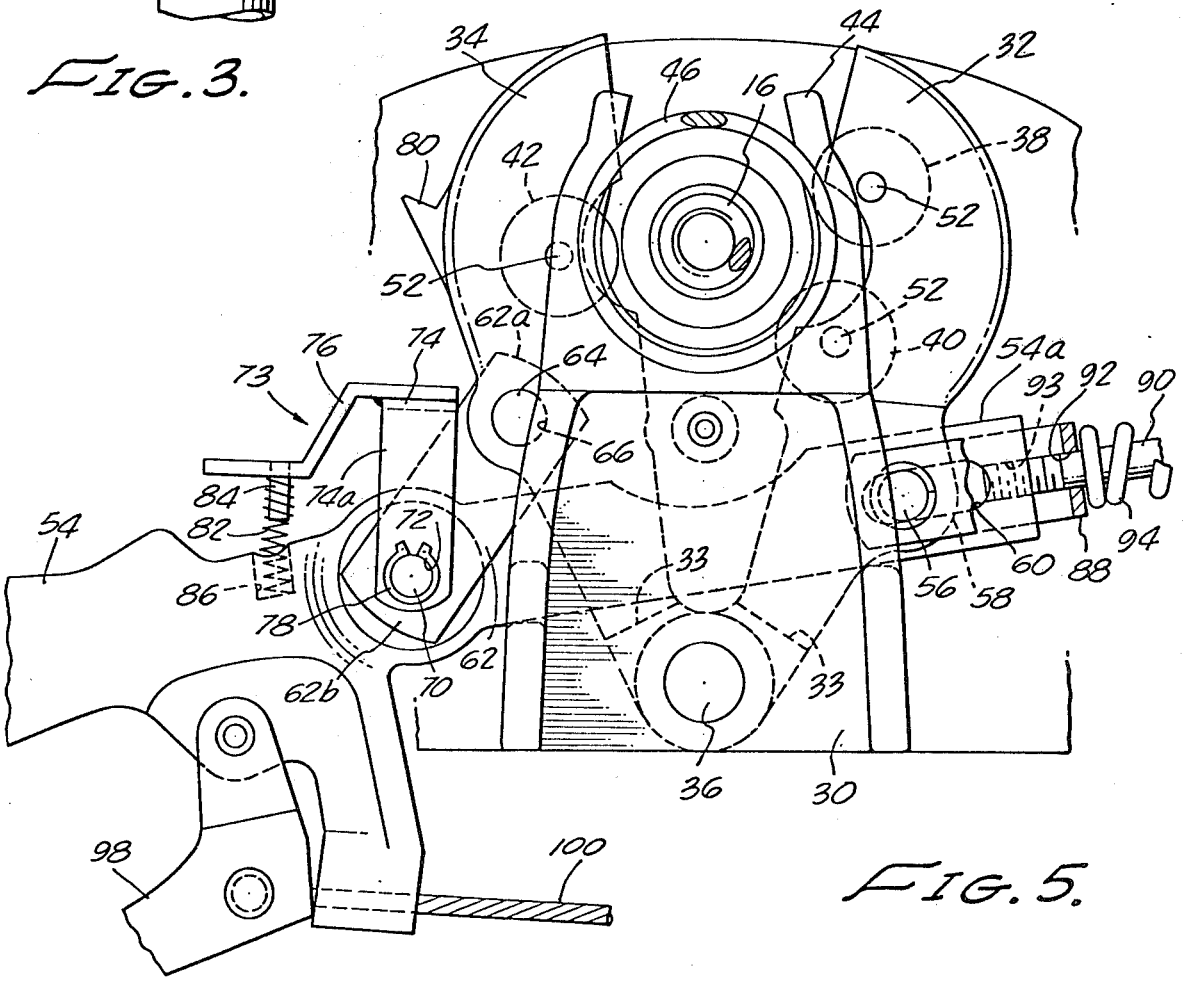
FIG. 5 is a central longtudinal view similar to FIG. 2 but showing the jaws and cooperating feed rollers of the device in a open non-feeding configuration.

Also forming a part of the feed control device of the invention is a gripping means, shown here as comprising an elongated, transversely extending handle 54, operably coupled with the snake engaging means for moving first and second jaws 32 and 34 from the first spaced apart position shown in FIG. 5 to the second closed position shown in FIG. 2.

As most clearly seen in FIG. 3, jaws 32 and 34 are provided with transverse slots 33 formed in their leg portions directly above pivot pin 36. Slots 33 are constructed so as to closely receive handle 54, which as shown in FIG. 2, has a first slotted end 54*a* and a second gripping end 54*b*. End 54*a* of handle 54 is connected to jaw 32 by means of a transversely extending pin 56 which is received in bores formed in outwardly protruding ears 58 of jaw 32 and extends through slot 60 of the slotted end of handle 54. Handle 54 is connected to jaw 34 at a location intermediate its ends by means of a pair of spaced apart pivot linking members 62, the ends 62*a* of which are connected to jaw 34 by means of a transversely extending pivot pin 64 which is received in bores 66 formed in outwardly protruding ears 68 of jaw 34. The opposite ends 62*b* of the linking members are pivotally connected to handle 54 by means of a pivot pin 70 extending through a bore 72 formed in handle 54.

With the construction thus described, when the gripping end 54*b* of handle 54 is pivoted upwardly from the position shown in FIG. 5 to the position shown in FIG. 2, jaws 32 and 34 will pivot about pin 36 into the closed position shown in FIG. 2 bringing the feed rollers into driving engagement with the snake.

To releasably secure the jaws 32 and 34 in the closed position there is provided locking means, shown in this embodiment of the invention as comprising a latching element 73 pivotally mounted on handle 54. Latching element 73 includes a "U" shaped element 74 having spaced apart leg portions 74*a* adapted to closely fit over linking members 62 (FIG. 4) and a downwardly stepped top plate 76 affixed to the bight portion of element 74. The lower ends of leg portions 74*a* are apertured to closely receive pivot pin 70 which is held captive within the assemblage by keepers 78 receivable within peripheral grooves formed proximate the extremities of pin 70.

Turning to FIGS. 2 and 5, jaw 34 can be seen to have an outwardly extending tooth-like protuberance 80 providing a locking surface adapted to lockably engage the bight portion of latching element 73 when the device is in the closed position shown in FIG. 2. With the locking means in the position illustrated in FIG. 2, handle 54 is locked against pivotal movement relative to jaws 32 and 34 and the device is secured in the snake feeding mode. To release the handle for movement to the position shown in FIG. 5, the stepped top plate 76 of the latching element is pivotally moved toward handle 54 against the urging of a second biasing means provided in the form of coiled spring 82. One end of coiled spring 82 is received over a downwardly protruding pin 84 carried by top plate 76 and the other end thereof is closely received within a bore 86 formed in the top of handle 54.

Forming an important part of the feed control device of the present invention is first biasing means for yieldably urging feed rollers 38, 40 and 42 into driving engagement with coiled spring 16. As best seen by referring to FIGS. 2, 4 and 5, in this form of the invention the first biasing means comprises a "U" shaped member 88 pivotally connected to jaw 32 by means of pin 56, a threaded member 90 extending through an aperture 92 formed in the bight portion of member 88 and threadably receivable within a threaded bore 93 formed in end 54*a* of handle 54, and a coiled spring 94 received over member 90. A knurled knob 96 is affixed to the outer end of member 90 and functions to hold spring 94 captive between the knob and the bight portion of member 88.

Due to the slotted construction of handle 54, jaw 32 and rollers 38 and 40 carried thereby are movable in a direction away from snake 16 against the urging of spring 94. By threading member 90 into the threaded bore 93 provided in end 54*a* of the handle, the force required to move jaw 32 and the rollers carried thereby away from the snake can be precisely regulated.

Referring again to FIG. 2, pivotally connected to handle 54 at its gripping end is a drum brake actuation lever 98 which is interconnected with a drum brake (not shown) by means of a cable 100. The drum brake forming no part of the present invention, however, will not be described in detail.

OPERATION

In operation of the embodiment of the invention shown in FIGS. 1 through 4, with handle 54 in the downward position shown in FIG. 5 the snake 16 is manually fed from drum 14 and is threaded through sleeve 44 so that it extends between open jaws 32 and 34. The handle is then lifted upwardly causing the rollers 38, 40 and 42 to move into close proximity with the snake and the bight portion of latching element 74 to move into locking engagement with protuberance 80. Next, the adjustment means is operated by rotation of knob 96 to compress spring 94 and to bring rollers 38, 40 and 42 into snug engagement with the snake. Motor 18 is then connected with a source of electrical power and is energized by either a manual switch on the motor or by stepping on the remote foot switch 102 (FIG. 1). Energization of the motor causes drum 14 and snake 16 to rotate. This in turn causes rotation of feed rollers 38, 40 and 42 and the axial advance of the snake 16. Retraction of the snake is accomplished by reversing the direction of rotation of the motor. As the snake is fed into the clogged pipe, the force exerted on the snake by the drive rollers can be varied as desired by rotation of knob 96 of the adjustment means.

Figure 6:
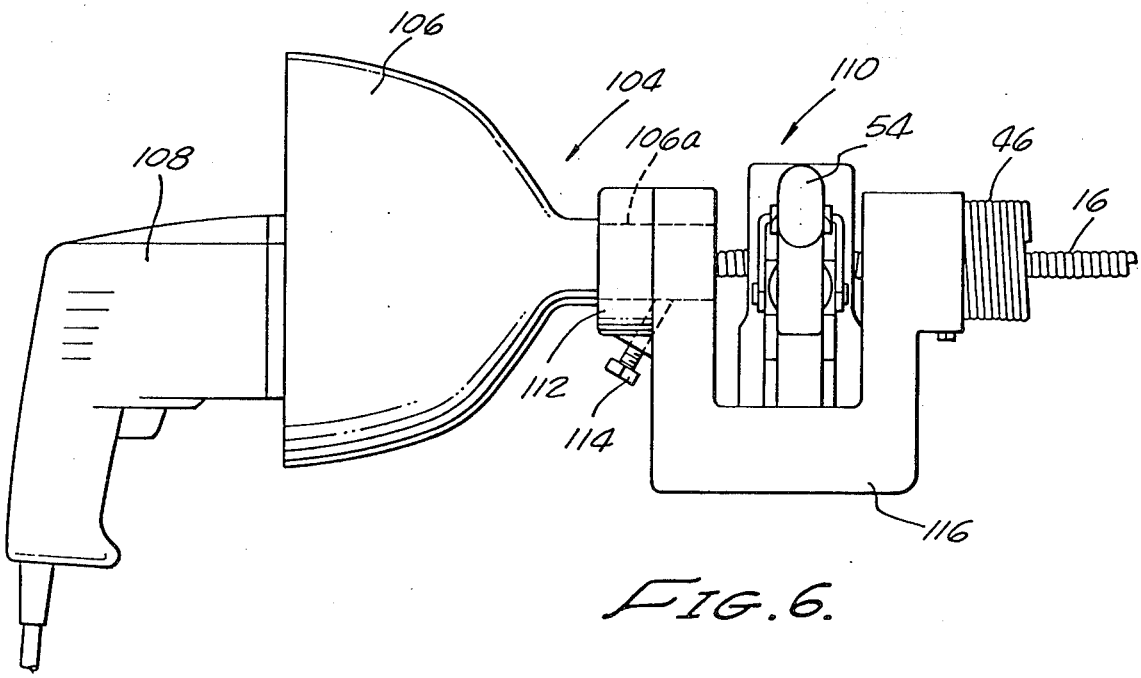
FIG. 6 is a side elevational view of another form of the device of the invention adapted to be connected to a hand held plumbing tool.

Referring to FIG. 6 there is shown another form of the feed device of the invention adapted for use in connection with a hand held plumber's tool 104. Tool 104 comprises a snake housing 106 in which the plumber's snake 16 is coiled. Housing 106 is mounted on, and rotated by, a hand held drill motor 108. The feed device of this form of the invention, generally designated by the numeral 110, is provided with a mounting collar 112 adapted to be closely received over the axially extending neck portion 106*a* of housing 106. The device is held securely in position by a locking set screw, or bolt 114.

Carried on a body 116 are first and second jaws, helically grooved rollers, gripping means and adjustment means of identical construction and assembly as previously described herein. These elements interact to feed the snake 16 in the same manner as the elements of the embodiment first described and such description will not be repeated here.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A feed control device for use with plumbing tools of the type having an elongated coiled spring wire or plumber's snake and means for rotating the snake about its longitudinal axis, comprising:

(a) snake engaging means movable into and out of driving engagement with the snake for feeding the snake axially of itself; said means comprising:
  (1) first and second jaws movable from a first spaced apart position to a second closed position proximate the snake;
  (2) a pair of feed rollers, rotatably carried by said first jaw;
  (3) at least one feed roller rotatably carried by said second jaw, each of said feed rollers having snake engaging surfaces adapted to operably engage the snake when said jaws are in said second position so as to urge axial movement of said snake relative to said feed rollers; and (b) gripping means operably coupled with said snake engaging means for moving said first and second jaws from said first position to said second position, including first biasing means for yieldably urging said feed rollers of said snake engaging means into driving engagement with the snake, said biasing means being responsive to forces opposing axial feeding of the snake so that said feed rollers will automatically move out of driving engagement with the snake in response to such forces.

2. A feed control device as defined in claim 1 including locking means for releasably locking said first and second jaws in said second closed position.

3. A feed control device as defined in claim 2 in which one of said first and second jaws is provided with a first locking surface and in which said locking means comprises:

(a) a latching element carried by said gripping means including a second locking surface adapted to lockably engage said first locking surface when said first and second jaws are in said second closed position; and (b) second biasing means adapted to yieldably urge said first and second locking surfaces into releasably locking engagement.

4. A feed control device as defined in claim 1 in which said gripping means comprises an elongated handle having first and second ends, said handle being connected at said first end to said first jaw and, at a location intermediate said first and second ends, being pivotally connected to said second jaw, whereby pivotal movement of said handle relative to said second jaw will cause said jaws to move from a first to a second position.

5. A feed control device as defined in claim 4 in which said handle is reciprocally movable relative to said first jaw and in which said first biasing means is adapted to yieldably resist reciprocal movement of said handle relative to said first jaw when said first and second jaws are in a second closed position.

6. A feed control device as defined in claim 5 including adjustment means for adjusting the degree of resistance offered by said first biasing means against reciprocal movement of said handle relative to said first jaw.

7. A feed control device as defined in claim 1 in which said feed rollers have a plurality of helical grooves formed about their peripheries adapted to mateably engage said snake.

8. A feed control device as defined in claim 7 in which said helical grooves of said feed rollers are formed to provide a triple coil advance of said snake.

9. A feed device for a plumber's tool having a helically coiled spring wire plumber's snake and means for rotating the snake, comprising:

(a) a body adapted to be attached to the plumber's tool;

(b) first and second jaws pivotally carried by said body for relative movement with respect to each other from a first position wherein said jaws are spaced apart to a second position wherein said jaws are in close proximity;

(c) a pair of spaced apart, generally cylindrical feed rollers rotatably carried by said first jaw;

(d) at least one generally cylindrical feed roller rotatably carried by said second jaw, each of said feed rollers having snake engaging surfaces adapted to engage the snake so as to urge axial movement thereof relative to said feed rollers and being movable into driving engagement with the snake upon movement of said jaws from said first to said second position;

(e) handle grip means for moving said jaws from said first position to said second position; and (f) biasing means for yieldably urging said feed rollers into driving engagement with said snake.

10. A feed control device as defined in claim 9 in which each of said feed rollers has a plurality of helical grooves about its periphery adapted to mateably engage said snake, said grooves being formed with increased lead whereby said snake will be rapidly advanced axially of itself upon rotation of said snake.

11. A feed control device as defined in claim 9 including manually operable locking means for releasably locking said jaws in said second position.

12. A feed device for a plumber's tool having a helically coiled spring wire plumber's snake and means for rotating the snake, comprising:

(a) a body adapted to be removably attached to the plumber's tool;

(b) first and second jaws pivotally mounted on said body for movement relative to each other from a first spaced apart position to a second closed position wherein said jaws cooperate to form an axialy passageway;

(c) at least one generally cylindrically shaped feed roller carried by each of said jaws, said feed rollers being characterized by having snake engaging surfaces formed about their peripheries adapted to engage said snake so as to urge axial movement thereof upon rotation of said snake; and (d) an elongated transversely extending handle having first and second ends, said handle being pivotally connected to said first jaw at said first end and being pivotally connected to said second jaw intermediate said first and second ends, whereby movement of said second end of said handle toward said second jaw will cause said first and second jaws to move into said second closed position.

13. A feed device as defined in claim 12 in which said first end of said handle is slotted to permit reciprocal movement of said handle relative to said first jaw and in which said feed device includes biasing means for yieldably resisting reciprocal movement of said handle relative to said first jaw.

14. A feed device as defined in claim 13 including adjustment means for adjusting the force exerted by said biasing means yieldably resisting reciprocal movement of said handle relative to said first jaw.

15. A feed device as defined in claim 14 including locking means for releasibly locking said jaws in said second closed position.

* * * * *